US010054405B2

(12) United States Patent
Alherimi

(10) Patent No.: US 10,054,405 B2
(45) Date of Patent: Aug. 21, 2018

(54) HAND-HELD PERSONAL-PROTECTION SHOCK DEVICE

(71) Applicant: Naim Alherimi, Navarre, FL (US)

(72) Inventor: Naim Alherimi, Navarre, FL (US)

( * ) Notice: Subject to any disclaimer, the term of this patent is extended or adjusted under 35 U.S.C. 154(b) by 362 days.

(21) Appl. No.: 15/137,237

(22) Filed: Apr. 25, 2016

(65) Prior Publication Data

US 2016/0327375 A1 Nov. 10, 2016

Related U.S. Application Data

(60) Provisional application No. 62/158,219, filed on May 7, 2015.

(51) Int. Cl.
*F41H 13/00* (2006.01)
*G08B 15/00* (2006.01)

(52) U.S. Cl.
CPC ..... *F41H 13/0018* (2013.01); *G08B 15/004* (2013.01); *G08B 15/005* (2013.01)

(58) Field of Classification Search
CPC .. F41H 13/0018; G08B 15/004; G08B 15/005
See application file for complete search history.

(56) References Cited

U.S. PATENT DOCUMENTS 5,193,048 A * 3/1993 Kaufman ..... F41H 13/0018 361/232
5,392,029 A * 2/1995 Chang ..... G08B 15/005 340/574
5,517,180 A * 5/1996 Masi ..... F41H 9/10 222/613
5,531,359 A * 7/1996 Winner ..... B65D 83/384 222/153.11
5,986,872 A * 11/1999 Chaput ..... A45B 3/00 135/16
D661,771 S * 6/2012 Nawaz ..... D22/117
8,424,548 B2 * 4/2013 Willey ..... A45B 1/04 135/66
D731,612 S * 6/2015 Ying ..... D22/117

* cited by examiner

*Primary Examiner* — Scott Bauer
(74) *Attorney, Agent, or Firm* — Keaty Law Firm, LLC

(57) ABSTRACT

A hand-held personal-protection shock device apparatus and method providing a safety-pin mechanism to prevent unauthorized use or use by an attacker who wrests the device away; a siren that sounds when unauthorized use is attempted; a hand-held configuration that is comfortable to grip securely, with the shocking elements positioned optimally; built-in recharging equipment; and a switch configuration which promotes safe, rapid, and efficient use in an attack by a person or animal.

20 Claims, 4 Drawing Sheets

HAND-HELD PERSONAL-PROTECTION SHOCK DEVICE

This non-provisional patent application claims priority of Provisional Patent Application No. U.S. 62/158219, Improved Non-Lethal Weapon Apparatus and Method, filed 7 May 2015, which is incorporated here.

BACKGROUND

This invention provides a hand-held personal-protection shock device apparatus and method.

Existing electroshock weapons or stun guns are subject to a number of drawbacks regarding their safe and efficient use in an attack by a person or animal, in contrast with their safe carrying and handling during the majority of time when no attack is occurring. For example, a unit that is small enough to be easily concealable might present a shock risk to the user because the shocking contacts are too close to the user's own hand. A unit that is bulky or awkward will be hard to constantly carry in the hand, at the ready. A unit that is hard to activate will be safer from accidental shock, but harder to use when needed. Alternatively, a unit that is easy to activate will be easier to accidentally activate. A unit that shoots projectiles to deliver a shock is difficult to use repeatedly for shocks to different areas on one attacker or on multiple attackers, but a unit having fixed shock contacts must be touched to the attacker, with the consequence that the unit must be thrust toward the attacker and away from the user, where the unit is then liable to being slapped away or being taken by the attacker.

A concern about existing electroshock weapons, as with any weapon, is accidental discharge by unauthorized users, including children, or accidental discharge by the authorized user when carrying the weapon in a pocket, purse, or bag, especially when trying to retrieve the weapon under the pressure of an impending or occurring attack.

Another major concern about electroshock weapons is the possibility that the weapon might be wrested away by an attacker and used by the attacker against the authorized user.

There is thus a need for a hand-held personal-protection shock device which can be carried in the hand, at the ready, comfortably and securely, so that it cannot be easily dislodged from the hand, with an activating procedure that is easy to use in the event of attack but safe against accidental discharge, with a provision to deactivate the device if it is taken away from the authorized user or otherwise comes into the possession of an attacker or other unauthorized user.

SUMMARY OF THE INVENTION

The hand-held personal-protection shock device apparatus and method of the present invention provides a safety-pin mechanism to prevent unauthorized use or use by an attacker who wrests the device away; a siren that sounds when unauthorized use is attempted; a hand-held configuration that is comfortable to grip securely, with the shocking elements positioned optimally; built-in recharging equipment; and a switch configuration which promotes safe, rapid, and efficient use in an attack by a person or animal.

BRIEF DESCRIPTION OF DRAWINGS

Reference will now be made to the drawings, wherein like parts are designated by like numerals, and wherein.

DETAILED DESCRIPTION

Figure 1:
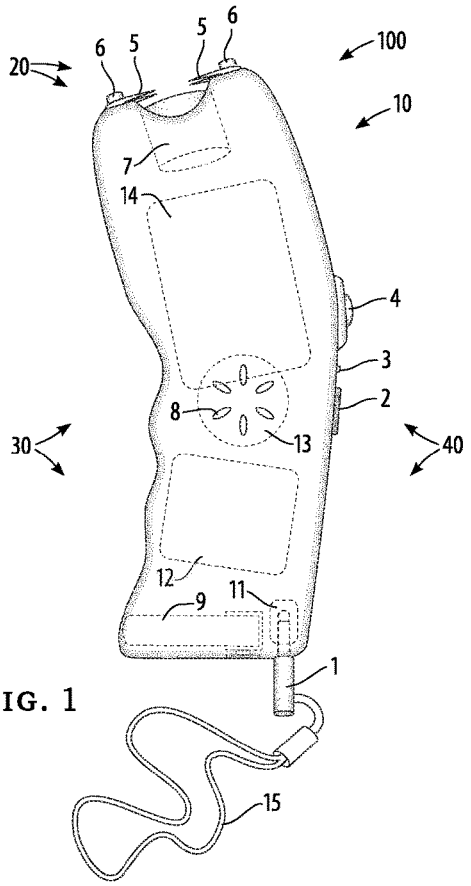
FIG. 1 is a schematic view of the hand-held personal-protection shock device with its safety pin inserted.
Figure 2:
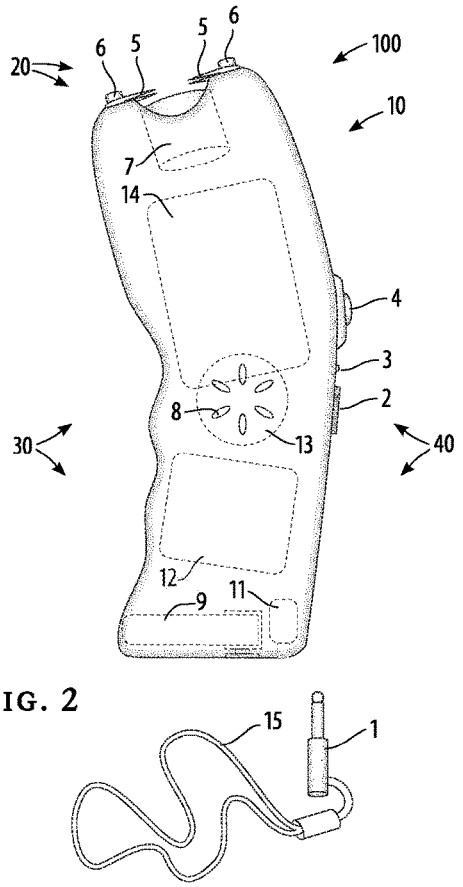
FIG. 2 is a schematic view of the hand-held personal-protection shock device with its safety pin removed.
Figure 3:
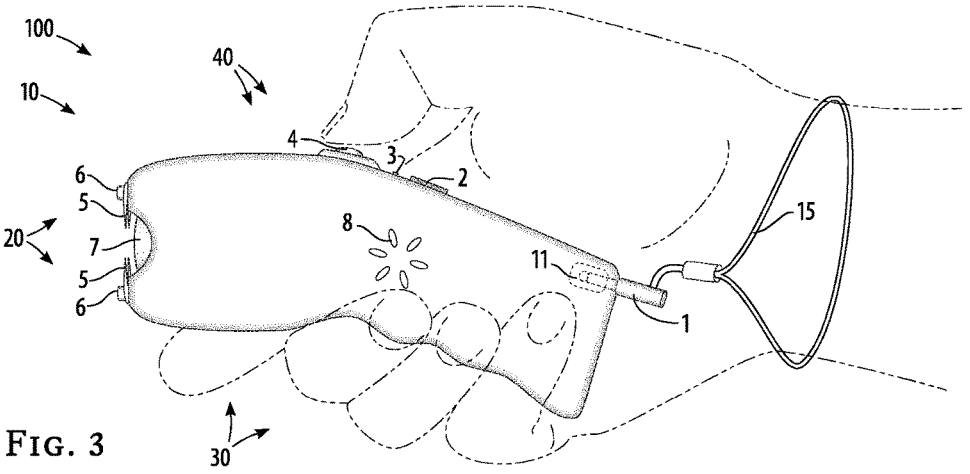
FIG. 3 is a schematic view of the hand-held personal-protection shock device in use, held in a hand.
Figure 4:
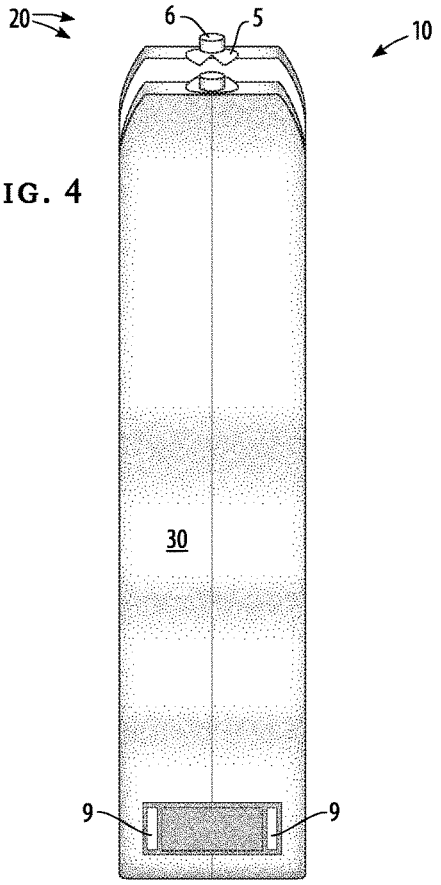
FIG. 4 is a view of the grip face of the hand-held personal-protection shock device.
Figure 5:
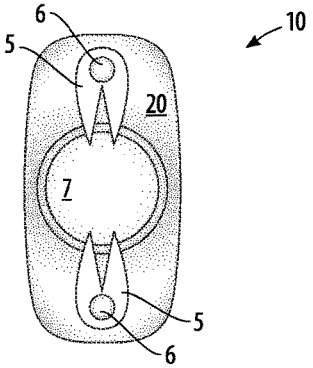
FIG. 5 is a view of the shock face of the hand-held personal-protection shock device.
Figure 7:
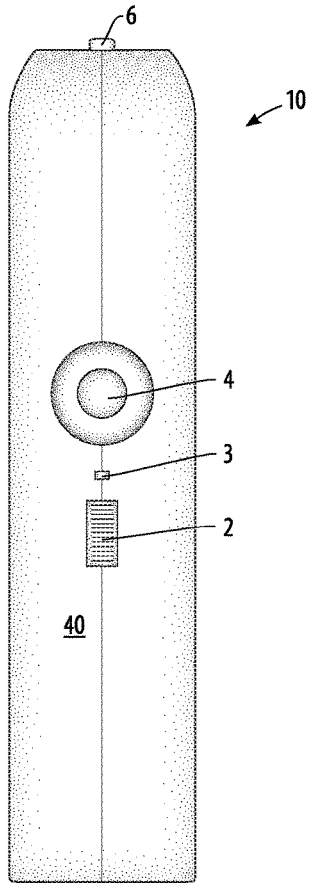
FIG. 7 is a view of the control face of the hand-held personal-protection shock device.
Figure 6:
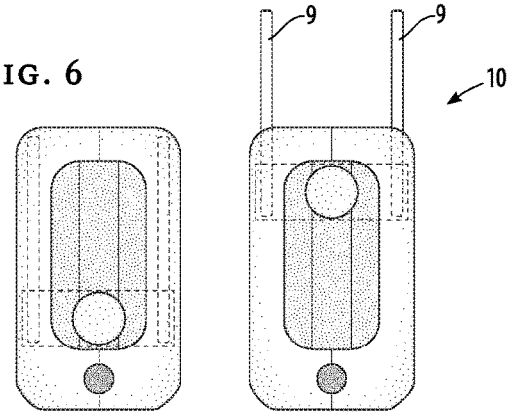
FIG. 6 is a view of the posterior face of the hand-held personal-protection shock device.
Figure 8:
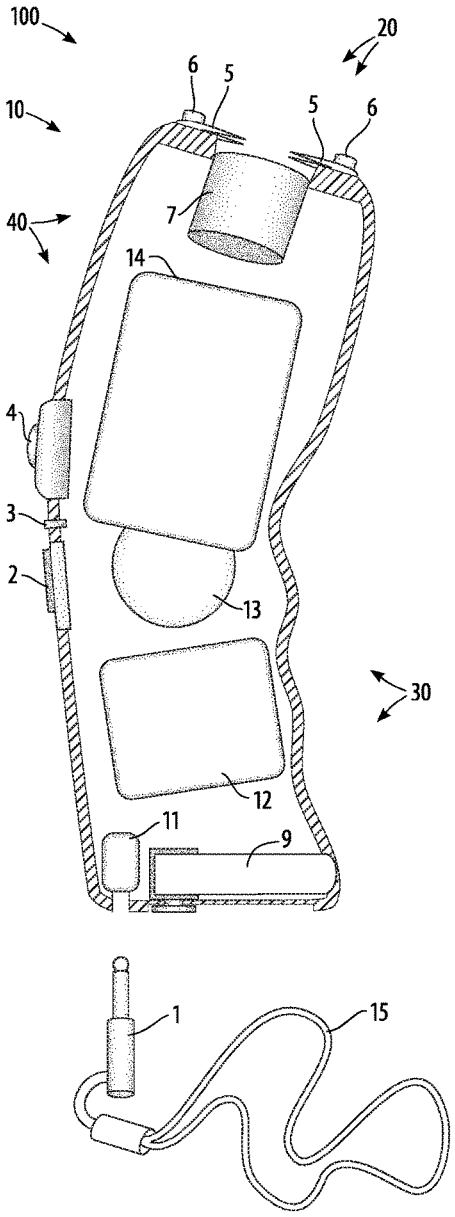
FIG. 8 is a schematic cutaway view of the hand-held personal-protection shock device with the adapter blades retracted.
Figure 9:
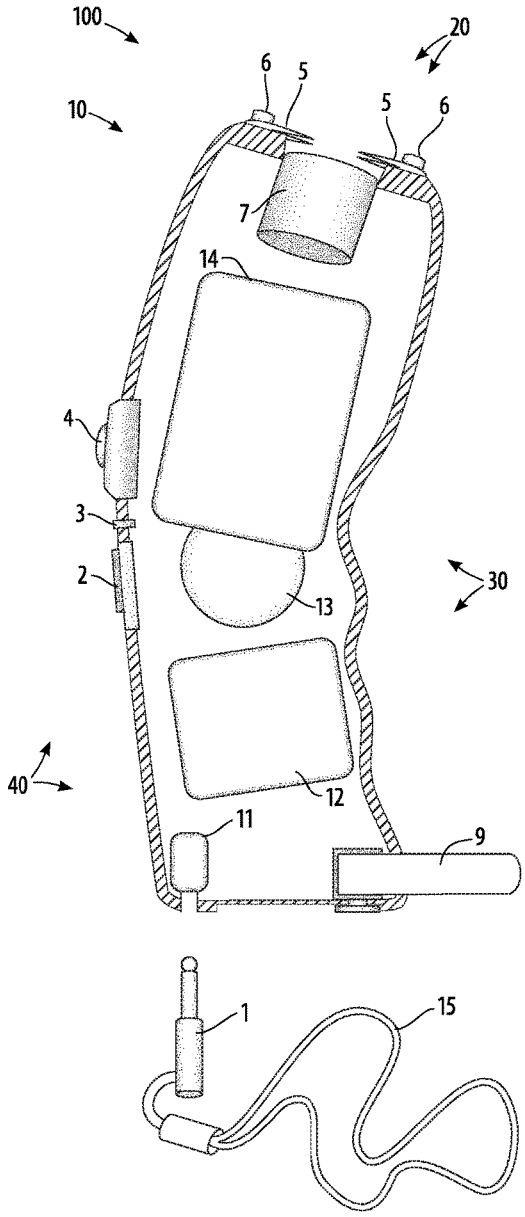
FIG. 9 is a schematic cutaway view of the hand-held personal-protection shock device with the adapter blades extended.
Figure 10:
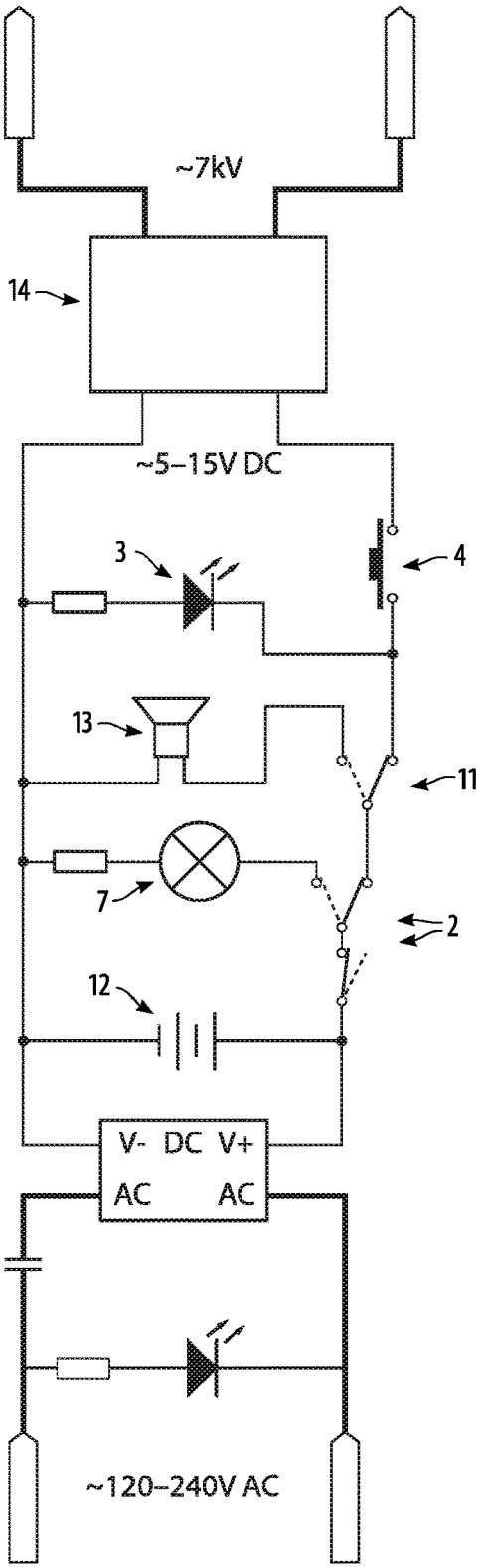
FIG. 10 is a circuit diagram of the hand-held personal-protection shock device.

Referring to all figures generally, an embodiment of the invention method 100 and the hand-held personal-protection shock device 10 apparatus are illustrated.

The hand-held personal-protection shock device 10 is sized to fit into the hand and is shaped for comfort in holding and for a secure grip that discourages the device being taken away by another. The invention has a shock face 20, a grip face 30, and a control face 40, as shown.

The shock face 20, which is the anterior surface and most distal from the user when the device is in use, has mounted to it two conducting shock plates 5 held fast by two conducting shock fasteners 6. These two conducting shock plates 5 are spaced apart from each other in order to create an arcing or sparking gap. A separation of about three-eights inch, or one centimeter, between the nearest points is a proper size of gap. The shock face also has a light 7 mounted into and through the face. This functions as a flashlight.

The grip face 30 has undulations to accommodate fingers and has an overall moderate curve or bend, too. Those two features allow for a good and secure grip on the device, with the body of the device at an angle, while the shock face 20 is held generally perpendicular to the ground. The undulations and the curve or bend provide a grip that makes it less likely that the device will be dropped or taken away, and more likely that the shock face 20 will be deployed in an effective orientation in fending off an attacker.

The control face 40 is closest to the thumb of the user. On the control face is the off-on-on switch 2, the indicator light 3, and the shock button switch 4. The off-on-on switch 2 has a first on position which activates the light 7, so that the hand-held personal-protection shock device 10 can be used as a flashlight. With the off-on-on switch 2 in this first position, no shock can be produced by the device. The off-on-on switch 2 has a second position which turns off the light 7 and either enables the production of shock or sounds an alarm, depending on the state of the safety-pin switch 11. When the production of shock is enabled, then pressing the shock button switch 4 closes a circuit which sends low-voltage from a rechargeable battery 12 to a high-from-low-voltage unit 14 that generates a high-voltage, low-current pulsed output, which is sent to the conducting shock plates 5 and causes electric arcing or sparking between the plates. An indicator light 3 becomes lit when the production of shock is enabled.

A removable safety pin 1 is provided in order to prevent the hand-held personal-protection shock device 10 from being used without authorization and from being used by an attacker who wrests the device from a user's hand. The removable safety pin 1 is plugged into or is taken out of the safety-pin switch 11, which is an on-on switch that routes a circuit either to the shock button switch 4, enabling shock production, or to a siren wafer 13, sounding an alarm. When the removable safety pin 1 is plugged into the safety-pin switch 11, then the circuit is routed to the shock button switch 4 and the production of shock is enabled. When the removable safety pin 1 is not plugged into the safety-pin switch 11, then the circuit is routed to the siren wafer 13, and an alarm is sounded. Both of these possibilities depend upon the off-on-on switch 2 being in the second position. If the off-on-on switch 2 is in the off position or in the first position, then the circuit does not extend to the safety-pin switch 11 and cannot be routed to produce a shock or an alarm.

If a person such as a child came into possession of a hand-held personal-protection shock device 10 but did not have the removable safety pin 1, then the device could only function as a flashlight or as an alarm. The removable safety pin 1 can optionally be attached to a lanyard 15 to go around the wrist, be clipped to a belt, or otherwise fixed to the user so that if the device is dropped or is wrested away, the device will not produce any shock and therefore cannot be used by an attacker against the user. If the hand-held personal-protection shock device 10 is enabled at the time it is wrested away, then the alarm will sound as soon as the safety pin is pulled out.

The device unit body is provided with one or more siren ports 8 allowing sound pressure produced by the siren wafer to escape from the device.

The hand-held personal-protection shock device 10 also provides a rechargeable battery 12 to store and provide low-voltage and moderately high current for the operation of the device. A battery rated at 250 mAh is sufficient.

Extendable adapter blades 9 are provided for the purpose of recharging the battery. The blades retract into the device unit body during normal use, and extend in order to be plugged into an AC electrical outlet for recharging. Conversion of AC into DC voltage for the purpose of charging the battery can be accomplished with a capacitor and integrated circuit known in the art.

The high-from-low-voltage unit 14 can be a step-up transformer, power inverter, oscillator, or diode-capacitor voltage multiplier calibrated with reference to the chosen replaceable battery 12 to produce a high-voltage, low-current rapidly pulsing electric shock sufficient for non-lethal disabling of an attacking person or animal.

The siren wafer 13 can be a piezoelectric speaker known in the art. The light 7 can be an LED, and the indicator light 3 can also be an LED. The off-on-on switch 2 can be a sliding switch with its off position at the nominal bottom, its first on position at the middle, and its second position at the top. The shock button switch 4 can be a normally open, momentary contact pushbutton switch.

Many changes and modifications can be made in the present invention without departing from the spirit thereof. I therefore pray that rights to the present invention be limited only by the scope of the appended claims.

What is claimed is:

1. A hand-held personal-protection shock device, comprising:

(i) a hollow device unit body sized and adapted to be held in the hand, having an anterior surface toward the distal part of the hand, a dorsal surface toward the thumb, a ventral surface toward the fingers, lateral surfaces, a posterior surface, and a medial axis;

(ii) a shock face on the anterior surface of said device unit body;

(iii) a control face on the dorsal surface of said device unit body having a convex curve relative to the medial axis;

(iv) a grip face on the ventral surface of said device unit body having a concave curve relative to the medial axis, and smaller undulating curves adapted to accommodate the fingers of the hand;

(v) a siren wafer adapted to emit sound when activated inside said device unit body;

(vi) at least one siren port through said device unit body adapted to allow the escape of sound;

(vii) a light mounted on and through said shock face and inside said device unit body;

(viii) two conducting shock fasteners mounting two conducting shock plates on said shock face at a distance appropriate to high-voltage arcing, adapted to convey high voltage to said shock face;

(ix) a removable safety pin adapted to be removably inserted into said device unit body;

(x) an on-on safety-pin switch adapted to accept said removable safety pin and to either enable a circuit to said conducting shock plates or close a circuit to said siren wafer;

(xi) a high-from-low-voltage unit adapted to generate a high-voltage, low-current output pulse from a lower-voltage, higher-current input and send the high-voltage output to said conducting shock plates;

(xii) a rechargeable battery adapted to provide low-voltage DC power to said high-from-low-voltage unit, said siren wafer, said indicator light, and said light;

(xiii) an off-on-on switch mounted on said control face adapted to block the flow of DC voltage, provide DC voltage to said light, or provide DC voltage to said conducting plates or siren wafer;

(xiv) an indicator light mounted on said control face;

(xv) a shock button on said control face adapted to close a circuit to said high-from-low-voltage unit; and (xvi) two extendable adapter blades adapted to receive AC electricity for the charging of said battery;

where moving said off-on-on switch from an off position to a first on position closes a circuit to and activates said light;

where moving said off-on-on switch to a second on position closes a circuit to said safety-pin switch;

where said safety-pin switch closes a circuit to said shock button switch when said safety pin is inserted, or closes a circuit to said siren wafer when said safety pin is not inserted or is removed; and where said shock button switch closes a circuit to said high-from-low-voltage unit if said off-on-on switch is set to a second position and said removable safety-pin is inserted into said safety-pin switch.

2. The hand-held personal-protection shock device of claim 1, where said device unit body has the approximate dimensions of five inches by two inches by one inch.

3. The hand-held personal-protection shock device of claim 1, where the convex curve of said control face and the concave curve of said grip face are bends of from 10 to 30 degrees, inclusive.

4. The hand-held personal-protection shock device of claim 1, where the convex curve of said control face and the concave curve of said grip face are bends of from 15 to 25 degrees, inclusive.

5. The hand-held personal-protection shock device of claim 1, where the convex curve of said control face and the concave curve of said grip face are bends of 25 degrees.

6. The hand-held personal-protection shock device of claim 1, further comprising:

(xvii) a lanyard attached to said removable safety pin, adapted to cause said removable safety pin to be pulled out of said device unit body if said hand-held personal-protection shock device is taken away.

7. The hand-held personal-protection shock device of claim 1, where said high-from-low-voltage unit is chosen from the group comprising step-up transformer, power inverter, oscillator, or diode-capacitor voltage multiplier.

8. The hand-held personal-protection shock device of claim 1, where the high-voltage, low-current output pulse generated by said high-from-low-voltage unit is 7000 Volts, approximately.

9. The hand-held personal-protection shock device of claim 1, where said rechargeable battery has a capacity of at least 250 milliamp hours.

10. The hand-held personal-protection shock device of claim 1, where said siren wafer is a piezoelectric speaker.

11. A method of personal protection using a hand-held personal-protection shock device, comprising:

(i) providing a hand-held personal-protection shock device, comprising:

(a) a hollow device unit body sized and adapted to be held in the hand, having an anterior surface toward the distal part of the hand, a dorsal surface toward the thumb, a ventral surface toward the fingers, lateral surfaces, a posterior surface, and a medial axis;

(b) a shock face on the anterior surface of said device unit body;

(c) a control face on the dorsal surface of said device unit body having a convex curve relative to the medial axis;

(d) a grip face on the ventral surface of said device unit body having a concave curve relative to the medial axis, and smaller undulating curves adapted to accommodate the fingers of the hand;

(e) a siren wafer adapted to emit sound when activated inside said device unit body;

(f) at least one siren port through said device unit body adapted to allow the escape of sound;

(g) a light mounted on and through said shock face and inside said device unit body;

(h) two conducting shock fasteners mounting two conducting shock plates on said shock face at a distance appropriate to high-voltage arcing, adapted to convey high voltage to said shock face;

(i) a removable safety pin adapted to be removably inserted into said device unit body;

(j) an on-on safety-pin switch adapted to accept said removable safety pin and to either enable a circuit to said conducting shock plates or close a circuit to said siren wafer;

(k) a high-from-low-voltage unit adapted to generate a high-voltage, low-current output pulse from a lower-voltage, higher-current input and send the high-voltage output to said conducting shock plates;

(l) a rechargeable battery adapted to provide low-voltage DC power to said high-from-low-voltage unit, said siren wafer, said indicator light, and said light;

(m) an off-on-on switch mounted on said control face adapted to block the flow of DC voltage, provide DC voltage to said light, or provide DC voltage to said conducting plates or siren wafer;

(n) an indicator light mounted on said control face;

(o) a shock button on said control face adapted to close a circuit to said high-from-low-voltage unit; and (p) two extendable adapter blades adapted to receive AC electricity for the charging of said battery;

where moving said off-on-on switch from an off position to a first on position closes a circuit to and activates said light;

where moving said off-on-on switch to a second on position closes a circuit to said safety-pin switch;

where said safety-pin switch closes a circuit to said shock button switch when said safety pin is inserted, or closes a circuit to said siren wafer when said safety pin is not inserted or is removed; and where said shock button switch closes a circuit to said high-from-low-voltage unit if said off-on-on switch is set to a second position and said removable safety-pin is inserted into said safety-pin switch;

(ii) carrying said hand-held personal-protection shock device in the hand; and (iii) using said hand-held personal-protection shock device upon an attacker when needed.

12. The method of personal protection using a hand-held personal-protection shock device of claim 11, where said device unit body has the approximate dimensions of five inches by two inches by one inch.

13. The method of personal protection using a hand-held personal-protection shock device of claim 11, where the convex curve of said control face and the concave curve of said grip face are bends of from 10 to 30 degrees, inclusive.

14. The method of personal protection using a hand-held personal-protection shock device of claim 11, where the convex curve of said control face and the concave curve of said grip face are bends of from 15 to 25 degrees, inclusive.

15. The method of personal protection using a hand-held personal-protection shock device of claim 11, where the convex curve of said control face and the concave curve of said grip face are bends of 25 degrees.

16. The method of personal protection using a hand-held personal-protection shock device of claim 11, further comprising:

(q) a lanyard attached to said removable safety pin, adapted to cause said removable safety pin to be pulled out of said device unit body if said hand-held personal-protection shock device is taken away.

17. The method of personal protection using a hand-held personal-protection shock device of claim 11, where said high-from-low-voltage unit is chosen from the group comprising step-up transformer, power inverter, oscillator, or diode-capacitor voltage multiplier.

18. The method of personal protection using a hand-held personal-protection shock device of claim 11, where the high-voltage, low-current output pulse generated by said high-from-low-voltage unit is 7000 Volts, approximately.

19. The method of personal protection using a hand-held personal-protection shock device of claim 11, where said rechargeable battery has a capacity of at least 250 milliamp hours.

20. The method of personal protection using a hand-held personal-protection shock device of claim 11, where said siren wafer is a piezoelectric speaker.

* * * * *